US012060628B2

(12) United States Patent
Fukae et al.

(10) Patent No.: US 12,060,628 B2
(45) Date of Patent: Aug. 13, 2024

(54) SINTERED VALVE GUIDE AND METHOD FOR PRODUCING SAME

(71) Applicant: HITACHI CHEMICAL COMPANY, LTD., Tokyo (JP)

(72) Inventors: Daisuke Fukae, Tokyo (JP); Hideaki Kawata, Tokyo (JP)

(73) Assignee: RESONAC CORPORATION, Tokyo (JP)

( * ) Notice: Subject to any disclaimer, the term of this patent is extended or adjusted under 35 U.S.C. 154(b) by 310 days.

(21) Appl. No.: 16/971,821

(22) PCT Filed: Feb. 22, 2019

(86) PCT No.: PCT/JP2019/006746

§ 371 (c)(1),
(2) Date: Aug. 21, 2020

(87) PCT Pub. No.: WO2019/163937

PCT Pub. Date: Aug. 29, 2019

(65) Prior Publication Data

US 2020/0391288 A1 Dec. 17, 2020

(30) Foreign Application Priority Data

Feb. 23, 2018 (JP) ..... 2018-030672

(51) Int. Cl.
*B22F 3/10* (2006.01)
*B22F 5/00* (2006.01)
(Continued)

(52) U.S. Cl.
CPC ..... *C22C 33/0264* (2013.01); *B22F 3/1003* (2013.01); *B22F 5/00* (2013.01); *F01L 3/08* (2013.01); *B22F 2301/35* (2013.01)

(58) Field of Classification Search
CPC ..... F01L 3/08
See application file for complete search history.

(56) References Cited

U.S. PATENT DOCUMENTS 6,012,703 A * 1/2000 Hayashi ..... F01L 3/08
251/368

FOREIGN PATENT DOCUMENTS

JP 52-98607 A 8/1977
JP 52098607 A * 8/1977
(Continued)

OTHER PUBLICATIONS

Espacenet machine translation of JP-52098607-A retrieved on Oct. 1, 2022 (Year: 1977).*

*Primary Examiner* — Jophy S. Koshy
*Assistant Examiner* — Joshua S Carpenter
(74) *Attorney, Agent, or Firm* — FITCH, EVEN, TABIN & FLANNERY, LLP

(57) ABSTRACT

A sintered valve guide having a metallic structure that has a matrix composed of a martensite phase dispersed in a pearlite single phase structure or a mixed structure of ferrite and pearlite, and a pore dispersed within the matrix, wherein the martensite phase exists in a proportion such that an area ratio of the martensite phase in a structure cross-section is within a range from 1 to 10% of the matrix is provided. A method for producing a sintered valve guide is provided, the method includes preparing a mixed powder by adding a copper-phosphorous alloy powder, a nickel powder and a graphite powder to an iron powder, molding the mixed powder into a molded body having a density of 6.8 to 7.2 $Mg/m^3$, and sintering the obtained molded body at a temperature of 950 to 1,200° C.

5 Claims, 2 Drawing Sheets

(51) Int. Cl.
*C22C 33/02* (2006.01)
*F01L 3/08* (2006.01)

(56) References Cited

FOREIGN PATENT DOCUMENTS

| | | | |
|---|---|---|---|
| JP | S55-34858 | A | 9/1980 |
| JP | 2680927 | B2 | 11/1997 |
| JP | 10-81943 | A | 3/1998 |
| JP | 4323069 | B2 | 9/2009 |
| JP | 4323467 | B2 | 9/2009 |

* cited by examiner

SINTERED VALVE GUIDE AND METHOD FOR PRODUCING SAME

CROSS-REFERENCE TO RELATED APPLICATIONS

This application is a U.S. national phase application filed under 35 U.S.C. § 371 of International Application No. PCT/JP2019/006746, filed Feb. 22, 2019, designating the United States, which claims priority from Japanese Application No. 2018-030672, filed Feb. 23, 2018, which are hereby incorporated herein by reference in their entirety.

TECHNICAL FIELD

The present invention relates to a sintered valve guide used in an internal combustion engine, and a method for producing the sintered valve guide.

BACKGROUND ART

A valve guide used in an internal combustion engine is a component of circular cylindrical shape in which the stems of an intake valve for sucking a fuel gas into the combustion chamber of the internal combustion engine and an exhaust valve for exhausting the combustion gases from the combustion chamber are supported by the inner peripheral surface of the valve guide. Accordingly, the valve guide is required to exhibit wear resistance itself, and is also required to maintain, for long periods, a smooth sliding state for the valve stems that prevents wear of the valve stems. Components manufactured from cast iron have conventionally been used as these valve guides, but components manufactured from sintered alloys (such as those disclosed in Patent Documents 1 to 4) are becoming more widespread. Reasons for using sintered alloys include the ability to obtain alloys having specific metallic structures that are unobtainable using wrought steels, thus enabling the alloys to be imparted with wear resistance, the ability to produce a large number of products of the same shape once a mold has been produced, making these sintered alloys suitable for mass production, and the ability to mold sintered alloys into near net shapes, meaning material yields associated with machining are high.

Patent Document 1 discloses a sintered valve guide material composed of an iron-based sintered alloy containing, by weight, 1.5 to 4% of carbon, 1 to 5% of copper, 0.1 to 2% of tin, 0.1 to less than 0.3% of phosphorus, and the remainder of iron. In this sintered valve guide material disclosed in Patent Document 1, an iron-phosphorus-carbon compound phase is precipitated in a pearlite matrix that has been strengthened by adding copper and tin. Further, the iron-phosphorus-carbon compound absorbs carbon from the surrounding matrix and grows in a plate-like manner, and as a result, a ferrite phase is dispersed in portions contacting the iron-phosphorus-carbon compound phase. Furthermore, copper that has dissolved in the matrix in an amount exceeding the normal temperature solid solubility limit under the high temperatures used during sintering precipitates in the matrix during cooling, causing a copper alloy phase to be dispersed in the matrix. This sintered valve guide material exhibits excellent wear resistance due to the iron-phosphorus-carbon compound phase, and is therefore increasingly being used by domestic and international automobile makers as a standard material for the valve guides for automobile internal combustion engines.

Further, the sintered valve guide material disclosed in Patent Document 2 is a material in which, in order to improve the machinability of the sintered valve guide material disclosed in Patent Document 1, magnesium metasilicate-based minerals and magnesium orthosilicate-based minerals and the like are dispersed as intergranular inclusions in the metallic matrix of the sintered valve guide material disclosed in Patent Document 1, and in a similar manner to that mentioned for the sintered valve guide material of Patent Document 1, this improved sintered valve guide material is increasingly being used by domestic and international automobile makers.

The sintered valve guide materials disclosed in Patent Documents 3 and 4 aim to provide further improved machinability, and are materials in which the machinability has been improved by reducing the amount of phosphorus, thereby reducing the amount of dispersed hard iron-phosphorus-carbon compound phase to the minimum amount required for maintenance of the wear resistance of the valve guide, and these sintered valve guide materials have also started to be used by domestic and international automobile makers.

PRIOR ART DOCUMENTS

Patent Documents

Patent Document 1: JP S55-34858 B
Patent Document 2: JP 2680927 B
Patent Document 3: JP 4323069 B
Patent Document 4: JP 4323467 B

SUMMARY OF THE INVENTION

Problems to be Solved by the Invention

In recent years, further improvements in the functionality of internal combustion engines (such as lower fuel consumption and higher output) have continued to occur, and there is a tendency for increased load to be applied to the valve guides. As a result, the demands for increased strength for sintered valve guides continue to grow.

Generally, in order to increase the strength of a sintered alloy, the porosity should be reduced, and the density increased.

The sintered valve guide materials of Patent Documents 1 to 4 have metallic structures in which Fe—P—C compounds are dispersed as a hard phase and a graphite phase is dispersed as a lubricant phase, and when stress is applied to these types of structures, stress tends to be concentrated at the interface between the matrix and the hard phase. When graphite is dispersed in the matrix, the binding strength of the iron matrix decreases. Furthermore, Fe—P—C compounds have Vickers hardness (Hv) values of 1,000 to 1,400, but although the hard phase has a degree of hardness that contributes to the material strength, the structure is brittle. Consequently, even if the density is increased, the Fe—P—C compounds tend to act as fracture points, making it difficult to improve the strength.

In light of these issues, an object of the present invention is to provide a sintered valve guide that has high strength and excellent wear resistance and machinability, and a method for producing the sintered valve guide.

Means to Solve the Problems

As a result of investigations by the inventors of the present invention aimed at achieving the above object, the inventors discovered that by improving the metallic structure so that an iron matrix having hardness itself functioned as the hard phase, the strength could be increased without producing Fe—P—C compounds that can act as stress fracture points, and the wear resistance could also be maintained.

Further, the inventors also discovered that by eliminating Fe—P—C compounds, the graphite phase that functions as a lubricant layer also becomes unnecessary, enabling the binding strength of the iron matrix to be increased, thereby further strengthening the structure.

According to one aspect of the present invention, a sintered valve guide has a metallic structure having a matrix composed of a martensite phase dispersed in a pearlite single phase structure or a mixed structure of ferrite and pearlite, and a pore dispersed within the matrix, wherein the martensite phase exists in a proportion such that the area ratio of the martensite phase in a structure cross-section is within a range from 1 to 10% of the matrix.

The martensite phase described above preferably has an average diameter of 1 to 200 μm in a structure cross-section. The composition of the sintered valve guide described above, expressed as a mass ratio, may include 0.8 to 5.7% of Cu, 0.2 to 3.0% of Ni, 0.05 to 1.2% of P, and 0.5 to 1.5% of C, with the remainder composed of Fe and unavoidable impurities. Alternatively, the composition, expressed as a mass ratio, may include 0.8 to 5.7% of Cu, 0.2 to 3.0% of Ni, 0.05 to 1.2% of P, 0.5 to 1.5% of C, and 0.01 to 1.5% of a machinability improver, with the remainder composed of Fe and unavoidable impurities. In such a case, the machinability improver is preferably composed of, by mass, at least one of 0.01 to 0.5% of boron nitride, 0.05 to 1.0% of a magnesium silicate mineral, and 0.1 to 1.5% of manganese sulfide.

Further, according to another aspect of the present invention, a method for producing a sintered valve guide includes preparing a mixed powder by adding a copper-phosphorus alloy powder containing 5 to 20% by mass of P, with the remainder composed of Cu and unavoidable impurities, a nickel powder and a graphite powder to an iron powder such that the mixed powder has a mass ratio of the copper-phosphorus alloy powder from 1.0 to 6.0%, a mass ratio of the nickel powder is from 0.1 to 3.0%, and a mass ratio of the graphite powder is from 0.5 to 1.5%, molding the mixed powder into a molded body having a shape corresponding with the sintered valve guide such that the molded body density is from 6.8 to 7.2 $Mg/m^3$, and then sintering the thus obtained molded body in a non-oxidizing atmospheric gas under normal pressure conditions at a temperature within a range from 950 to 1,200° C.

In the preparation of the mixed powder described above, by also adding a powder of at least one machinability improver selected from among boron nitride, magnesium silicate minerals and manganese sulfide to the mixed powder such that the mass ratio of the boron nitride powder is from 0.01 to 1.0%, the mass ratio of the magnesium silicate mineral powder is from 0.05 to 1.0%, and/or the mass ratio of the manganese sulfide powder is from 0.1 to 1.5%, the machinability can be improved. The average particle diameter of the above nickel powder is preferably within a range from 1 to 50 μm.

Effects of the Invention

According to the present invention, a sintered valve guide having high strength and excellent wear resistance and machinability is provided which can meet the demands for further improvements in the functionality of internal combustion engines (such as lower fuel consumption and higher output). Further, the present invention also provides a method for producing a sintered valve guide that enables a sintered valve guide having the types of excellent mechanical properties described above to be produced easily.

EMBODIMENTS FOR CARRYING OUT THE INVENTION

[Metallic Structure of Sintered Valve Guide]

Figure 1:
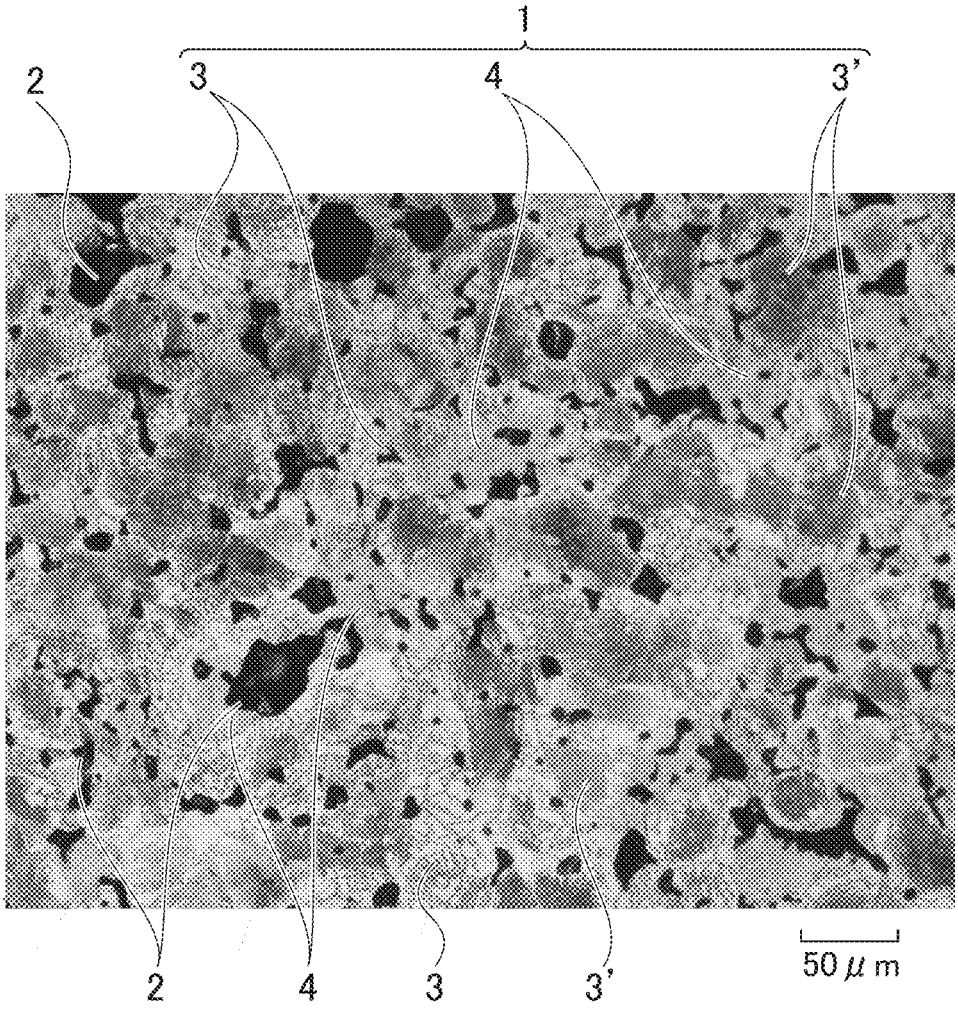
FIG. 1 is a captured image of a structure cross-section illustrating one example of the metallic structure of a sintered valve guide of the present invention.

The composition of the sintered material that constitutes the sintered valve guide of the present invention is an inexpensive, high-strength iron alloy, and has a metallic structure having a matrix composed of the iron alloy and a pore dispersed through the matrix. The matrix of the iron alloy has a structure that has a pearlite single phase structure or a mixed structure of ferrite and pearlite as the basic structure, with a martensite phase dispersed within this structure. In an example of the sintered valve guide illustrated in FIG. 1, pores 2 are dispersed in a matrix 1, and the matrix 1 has a single phase structure of pearlite 3 with a martensite phase 4 dispersed therein.

Pearlite has strength, whereas martensite has the highest hardness among the components that constitute the matrix, and functions as a hard phase. In other words, the matrix strength exhibited by the pearlite is further strengthened by the hardness of the martensite phase. In the sintered valve guide of the present invention, the hard martensite phase described above functions as a hard phase. The hardness (Hv) of martensite is within a range from about 500 to 800, and although this hardness is low compared with that of the Fe—P—C compounds used as conventional hard phase components, the phase toughness is superior to that of Fe—P—C compounds. Moreover, the martensite phase is formed by a phase transformation of the iron alloy matrix, and the interphase continuity at the interface is excellent. Accordingly, stress is unlikely to become concentrated at the interface, thereby improving the strength of the sintered valve guide.

Further, because the Fe—P—C compounds used as the hard phase in conventional sintered valve guides have an extremely high hardness (Hv) of 1,000 to 1,400, a graphite phase that functions as a lubricant phase is necessary, but because the hardness of the martensite that is used as the hard phase in the sintered valve guide of the present invention is of a level that permits elimination of a lubricant phase, the graphite phase that has conventionally been used as a lubricant phase may be omitted. Accordingly, the strength of the iron alloy matrix is not impaired by graphite, enabling the strength of the matrix to be satisfactorily improved. In this regard, introduction of the martensite phase contributes to an improvement in the strength of the sintered valve guide. Consequently, the sintered valve guide of the present invention having the type of metallic structure described above has similar wear resistance to conventional products and improved strength. Moreover, because no hard Fe—P—C compounds exist, the machinability also improves.

Pearlite is a eutectoid of ferrite (α-iron) and cementite (an Fe—C compound: $Fe_3C$), and the iron alloy matrix contains iron and carbon. Martensite is composed of a solid solution of carbon and the like in α-iron. The amount and size of the martensite phase produced in the iron alloy matrix can be adjusted by the degree of diffusion of nickel (Ni) into the iron, and therefore the iron alloy that constitutes the sintered valve guide contains nickel. By adjusting the settings for the particle size of the nickel powder used in producing the sintered valve guide and the temperature conditions, the amount and size of the martensite phase can be controlled. Further, copper (Cu) is used as a component that is useful in increasing the strength of the matrix, and this copper improves the hardenability of the matrix, and enhances the strength of the matrix by micronizing the pearlite in the cooling process conducted following sintering. Accordingly, the iron alloy that constitutes the sintered valve guide contains copper.

In terms of the diffusion of copper into the matrix, use of a component capable of forming a eutectic liquid phase with copper is preferred from the viewpoint of avoiding sintering at high temperature, and an example of this type of eutectic component is phosphorus (P). Accordingly, if phosphorus is used, then the iron alloy that constitutes the sintered valve guide will also contain phosphorus (P).

In the sintered valve guide of the present invention, if the amount of the martensite phase described above is too small, then the wear resistance will be inferior, whereas if the amount of the martensite phase is too large, the machinability deteriorates. Considering these factors, the amount of the martensite phase dispersed in the iron alloy matrix, expressed as an area ratio in a metallic structure cross-section when a cross-section of the sintered valve guide is inspected, is preferably within a range from at least 1% to not more than 10% of the matrix. Provided the amount falls within this type of range, favorable wear resistance and machinability is achieved for matrices based on both pearlite single phase structures and mixed structures of ferrite and pearlite.

If the size of the martensite phase described above is too large, then the martensite tends to become unevenly distributed within the metallic structure, and there is a possibility of a reduction in the wear resistance improvement effect. As a result, in a cross-section of the metallic structure, the martensite phase is preferably of a size that results in an average diameter of not more than 200 μm. On the other hand, if the size of the martensite phase is too small, then there is a possibility that the wear resistance may deteriorate. Accordingly, a size that results in an average diameter of at least 1 μm is preferred. The average diameter of the martensite phase uses a value obtained by calculating the average area per single phase from the total area of the martensite phase in a metallic structure cross-section as measured by image analysis, and then converting that average area to an area-equivalent circle diameter.

[Preferred Composition and Raw Material Powders for Sintered Valve Guide]

The composition of the sintered valve guide that has the metallic structure described above, expressed as a mass ratio, preferably contains 0.8 to 5.7% of Cu, 0.2 to 3.0% of Ni, 0.05 to 1.2% of P, and 0.5 to 1.5% of C, with the remainder composed of Fe and unavoidable impurities.

Further, using the above composition as a base, the sintered valve guide of the present invention may also contain a machinability component for improving the machinability of the matrix. In such a case, the sintered valve guide preferably has a composition, expressed as a mass ratio, that contains 0.8 to 5.7% of Cu, 0.2 to 3.0% of Ni, 0.05 to 1.2% of P, 0.5 to 1.5% of C, and 0.01 to 1.5% of a machinability improver, with the remainder composed of Fe and unavoidable impurities. The machinability improver is preferably at least one of boron nitride, a magnesium silicate mineral and manganese sulfide, and the proportions of those machinability improvers in the composition are preferably 0.01 to 1.0% of boron nitride, 0.05 to 1.0% of a magnesium silicate mineral, and 0.1 to 1.5% of manganese sulfide.

In order to produce an iron alloy having the compositional structure described above, during the production of the sintered valve guide, iron is used as the main component, and the matrix is strengthened by adding other components to the iron, thereby achieving an increase in the strength of the sintered valve guide. The iron is preferably supplied in the form of an iron powder (pure iron powder) composed of iron and unavoidable impurities, and in terms of blending the other components, powders of each of the other components are preferably added to and mixed with the iron powder to prepare a mixed powder, with this mixed powder then being used as the raw material powder.

Copper undergoes solid solution in iron upon sintering to form an alloy, and contributes to improving the strength of the matrix, as well as having an action that improves the hardenability of the matrix, and as a result, contributes to an improvement in the strength of the sintered valve guide by micronizing the pearlite in the cooling process conducted following sintering. Accordingly, the use of copper is desirable in terms of realizing these actions, and when used, the amount of copper is preferably at least 0.8% by mass of the total composition. However, if the amount of copper is too large, then there is a possibility that a soft copper phase or copper alloy phase may precipitate in the matrix, causing a reduction in strength, and therefore the amount is preferably not more than 5.7% by mass. The copper is preferably added in the form of a copper powder or copper alloy powder, which is added to and mixed with the iron powder that represents the main raw material powder.

The effects described above are obtained by diffusion of the copper within the iron powder. In those cases where a copper powder is used, in order to achieve liquid phase sintering, the mixture is heated to a temperature at least as high as the melting point of copper (1,084.6° C.) to melt the copper powder. In this regard, by using a copper alloy powder that forms a eutectic liquid phase with copper, such as a copper-tin alloy (liquid phase formation temperature: 798° C.) powder or a copper-phosphorus alloy (liquid phase formation temperature: 714° C.) powder, a eutectic liquid phase can be formed from the copper alloy powder at a lower temperature, and therefore a liquid phase can be formed during the temperature raising process for reaching the sintering temperature, which contributes to micronization of the sintered alloy that contributes to improved strength.

In those cases where a copper alloy powder is used, because phosphorus undergoes solid solution in iron and has a strengthening action, the use of a copper-phosphorus alloy powder is preferred. Tin is a component that causes embrittlement of iron, and may cause a deterioration in the strength of the iron alloy, and therefore if a copper-tin alloy powder is used, the amount added is preferably controlled.

In those cases where a copper-phosphorus alloy powder is used, if the amount of phosphorus is too small, then the amount of the Cu—P eutectic liquid phase formed is limited, and therefore the amount of phosphorus is preferably at least 0.05% by mass of the total composition. However, as the amount of phosphorus increases, there is an increased chance of precipitation of Fe—P—C compounds. Accordingly, the amount of phosphorus in the total composition is preferably not more than 1.2% by mass.

In the sintered valve guide of the present invention, as mentioned above, the matrix has a basic structure that is either a pearlite single phase structure or a mixed structure of ferrite and pearlite. Pearlite is a steel structure in which fine cementite is precipitated in a lamellar arrangement in ferrite, but in the case of a structure that contains phosphorus, the phosphorus either undergoes solid solution in the ferrite, or can precipitate in the ferrite as fine Fe—P—C compounds (the portions labeled pearlite 3' in FIG. 1) instead of cementite (an Fe—C compound: $Fe_3C$). In the present invention, Fe—P—C compounds are not intentionally produced, but in the case of a composition that contains phosphorus, small amounts of Fe—P—C compounds produced as components of the pearlite structure are permitted. In other words, there are no particular problems provided a large Fe—P—C compound phase such as that found in conventional materials is not formed, and the present invention does not totally exclude Fe—P—C compounds.

A copper-phosphorus alloy powder that is used is preferably a powder composed of 5 to 20% by mass of P and the remainder of Cu and unavoidable impurities. When a copper-phosphorus alloy powder of this composition is used, 1.0 to 6.0% by mass of the copper-phosphorus alloy powder is preferably added to the iron powder used as the main raw material, which enables the amount of copper in the overall composition to be adjusted to a value of 0.8 to 5.7% by mass, and the amount of phosphorus to be adjusted to a value of 0.05 to 1.2% by mass.

Nickel is an element that has a significant effect in improving the hardenability of iron, and in portions having a high nickel concentration, iron can undergo a phase transformation into martensite, thereby dispersing a martensite phase within the matrix. Nickel is preferably added in the form of a nickel powder composed of nickel and unavoidable impurities. During the sintering process, nickel diffuses from the particles of the nickel powder into the matrix, and iron diffuses into the nickel particles from the surrounding matrix. As a result, in the portions representing the original nickel particles, an iron alloy having a high nickel concentration is formed, and in the cooling process conducted following sintering, the portions of iron alloy having a high nickel concentration undergo a phase transformation into a martensite phase, thus forming a sintered iron alloy having a martensite phase dispersed within the matrix. If the amount of nickel is too small, then the amount of the martensite phase obtained through a typical sintering process and cooling process tends to be insufficient, and in order to produce the desired amount of the martensite phase, a rapid cooling device and the like must be installed in the sintering furnace. In contrast, if the amount of nickel is too large, then there is a possibility that a martensite phase exceeding the desired amount may be produced. Accordingly, the compositional proportion of nickel in the overall structure is preferably at least 0.2% by mass but not more than 3.0% by mass. Further, when nickel is introduced in the form of a nickel powder, 0.2 to 3.0% by mass of the nickel powder is preferably added to and mixed with the iron powder that represents the main raw material.

In those cases where the nickel is added in the form of a nickel powder, if the particle size of the nickel powder is too small, then forming localized portions having a high nickel concentration becomes difficult, and producing a martensite phase of the desired amount becomes problematic. Consequently, a nickel powder having an average particle diameter of at least 1 μm is preferably used. In this description, the average particle diameter of a powder is indicated by the median diameter ($D_{50}$). The median diameter can be measured using the laser analysis method prescribed in Japanese Industrial Standard (JIS) 8825, and can be determined based on a particle size distribution measured using a laser diffraction/scattering Microtrac particle size distribution analyzer or the like.

If the particle size of the nickel powder is too large, then even if diffusion between the nickel and iron occurs during sintering, diffusion through to the central portion of the nickel particles does not occur satisfactorily and a high nickel concentration is maintained, meaning there is a possibility that portions having an overly high nickel concentration will remain in the iron alloy. These types of portions of high nickel concentration do not undergo transformation to a martensite phase even upon cooling, and may sometimes be retained as an austenite phase (Ni-rich austenite phase). An austenite phase is a metal structure that exhibits excellent toughness, but is also soft, and is therefore prone to adhesion to stems of the mating material, increasing the likelihood of adhesive wear of the sintered valve guide. Consequently, in the sintered valve guide of the present invention, it is preferable that no austenite phase remains. Accordingly, it is effective to restrict the size of the nickel powder, expressed as the average particle diameter, to not more than 50 μm, and therefore a nickel powder having an average particle diameter of 1 to 50 μm is preferably used. Formation of an austenite phase can be prevented by promoting diffusion of the nickel, and therefore formation of an austenite phase can also be prevented by increasing the sintering temperature or lengthening the sintering time.

Carbon (C) strengthens the matrix, and forms the matrix in a pearlite single phase structure or a mixed structure of ferrite and pearlite, thereby contributing to an improvement in the strength of the sintered valve guide. Further, a martensite phase is formed in portions having a high nickel concentration, thereby contributing to an improvement in the wear resistance. If the amount of carbon is too small, then forming the metal structure described above becomes difficult. On the other hand, if the amount of carbon is too large, then a hard and brittle cementite phase is more likely to precipitate at the grain boundaries, and if phosphorus is also included, precipitation of a Fe—P—C compound phase becomes more likely. Accordingly, there is a possibility of a reduction in the strength of the sintered alloy. Consequently, the proportion of carbon in the overall composition is preferably at least 0.5% by mass but not more than 1.5% by mass.

Carbon may be introduced into the raw material powder using a graphite powder or the like. If the carbon is introduced in the form of a steel powder formed by generating a solid solution of the carbon in the iron powder that represents the main raw material, then the main raw material powder becomes hard, and the compressibility of the raw material powder deteriorates. Consequently, the carbon is preferably added in the form of a graphite powder and mixed with the iron powder of the main raw material.

Based on the above description, in the basic structure of the present invention, the composition of the sintered valve guide preferably contains, by mass, 0.8 to 5.7% of Cu, 0.2 to 3.0% of Ni, 0.05 to 1.2% of P, and 0.5 to 1.5% of C, with the remainder composed of Fe and unavoidable impurities.

The raw material powder used for producing the sintered valve guide preferably employs a mixed powder obtained by adding and mixing, by mass, 1.0 to 6.0% of a copper-phosphorus alloy powder, 0.1 to 3.0% of a nickel powder, and 0.5 to 1.5% of a graphite powder with an iron powder, wherein the copper-phosphorus alloy powder is preferably composed of 5 to 20% by mass of P and the remainder of Cu and unavoidable impurities.

Because the sintered valve guide of the present invention can be produced without using a hard and brittle Fe—P—C compound phase, the machinability also improves. In those cases where further improvement in the machinability is required, a machinability improver may be selected appropriately from among conventional machinability improvers and used, and by dispersing the machinability improver within the matrix or pore, the machinability can be improved. Specifically, at least one material selected from among boron nitride (BN), magnesium silicate minerals such as enstatite ($MgSiO_3$) and manganese sulfide (MnS) may be used as the machinability improver, and is added to and mixed with the raw material powder in the form of a powder. If the amount added of the machinability improver is too small, then the machinability improvement effect may deteriorate. On the other hand, there is a possibility that the machinability improver may impair particle binding of the iron matrix during sintering, and therefore if the amount added is too large, then there is a possibility that the strength of the iron matrix may decrease, causing a reduction in the strength of the sintered valve guide. From this viewpoint, the machinability improver is preferably added in an amount that yields a proportion of about 0.01 to 1.5% by mass within the overall composition. When boron nitride is used, the amount used preferably yields a proportion of 0.01 to 0.5% by mass within the overall composition, when a magnesium silicate mineral is used, the amount used preferably yields a proportion of 0.05 to 1.0% by mass within the overall composition, and when manganese sulfide is used, the amount used preferably yields a proportion of 0.1 to 1.5% by mass within the overall composition. These machinability improvers may be used individually, or a combination of two or more machinability improvers may be used. When a combination of a plurality of machinability improvers is used, the total amount used is preferably from 0.01 to 1.5% by mass.

Accordingly, in those cases where a machinability improver is dispersed within the matrix or pore, the aforementioned iron powder, copper-phosphorus alloy powder, nickel powder and graphite powder are mixed with at least one machinability improver to prepare the mixed powder of the molding raw material.

[Method for Producing Sintered Valve Guide]

A method for producing the sintered valve guide of the present invention includes preparing the raw material powder described above, molding this raw material powder into a substantially circular cylindrical shape, and sintering the thus obtained molded body. This method yields a sintered valve guide having a matrix with a structure in which a martensite phase is dispersed in a pearlite single phase structure or a mixed structure of ferrite and pearlite, wherein the martensite phase exists in a proportion such that the area ratio of the martensite phase in a cross-section of the metallic structure is within a range from 1 to 10% of the matrix. During the molding, the molding conditions are set so as to achieve a molded body density of 6.8 to 7.2 $Mg/m^3$. The obtained molded body is sintered by heating in a non-oxidizing atmospheric gas under normal pressure conditions at a temperature within a range from 950 to 1,200° C. By sintering a molded body having a molded body density of 6.8 to 7.2 $Mg/m^3$, the sintered body density of the obtained sintered valve guide is within a range from 6.75 to 7.15 $Mg/m^3$, and the sintered valve guide has satisfactory strength. The gas atmosphere during sintering may be a reduced pressure atmosphere, but if the associated costs are considered, then a normal pressure gas atmosphere is adequate. If the atmospheric gas is oxidizing, then there is a possibility that the iron powder that represents the main raw material may oxidize, making particle binding within the matrix less likely to proceed satisfactorily, and also a possibility that the carbon added in the form of a graphite powder may bond to the oxygen in the atmosphere, causing a reduction in the amount of carbon retained within the iron alloy. Accordingly, the atmosphere during sintering employs a non-oxidizing gas.

The cooling rate following sintering is preferably set so that the average cooling rate during cooling from the sintering temperature to 300° C. is within a range from 5 to 40° C./minute. The cooling rate generally differs depending on the type of sintering furnace used, but in the case of a belt sintering furnace in which the molded body is placed on a heat-resistant belt and the belt is transported using a drum or the like while the molded body undergoes sintering, the average cooling rate from the sintering temperature to 300° C. is within a range from 10 to 50° C./minute, whereas in the case of a pusher sintering furnace in which the molded body is mounted inside a tray and the tray is then pushed into the sintering furnace, the average cooling rate from the sintering temperature to 300° C. is within a range from 5 to 40° C./minute. Accordingly, regardless of whether a belt sintering furnace or a pusher sintering furnace is used, a special cooling device is not required, and additional devices need not be used.

Example 1

Powders (a) to (f) described below (the average particle diameters represent median diameters based on particle size distribution measurements) were prepared as raw materials, and were combined and mixed in the blend proportions shown in Table 1 to prepare raw material mixed powders. In order to produce sintered alloy samples for forming sintered valve guides, each of the obtained raw material mixed powders was subjected to pressure powder molding to form a circular cylindrical shape with an outer diameter of 14 mm and a length of 45 mm (inner diameter: 6 mm, for wear testing) and a square bar shape having a length of 90 mm and a 15 mm square cross-section (for fatigue testing), thus obtaining molded bodies having the densities shown in Table 2. The molded body density was adjusted by altering the amount of raw material powder used. Each obtained molded body was heated to a sintering temperature shown in Table 1 in a nitrogen gas atmosphere, and following sintering for 60 minutes with the temperature maintained, the sintered body was cooled. During cooling, the average cooling rate from the sintering temperature to 300° C. was 12° C./minute. The above method was used to produce sintered alloy samples with sample numbers 1 to 38.

(a) Iron powder (average particle diameter: 70 μm)

(b) Copper-phosphorus alloy powder containing 5% by mass of P and the remainder composed of Cu and unavoidable impurities (average particle diameter: 50 μm)

(c) Copper-phosphorus alloy powder containing 8% by mass of P and the remainder composed of Cu and unavoidable impurities (average particle diameter: 40 μm)

(d) Copper-phosphorus alloy powder containing 20% by mass of P and the remainder composed of Cu and unavoidable impurities (average particle diameter: 40 μm)

(e) Nickel powder (average particle diameter: 5 μm)

(f) Graphite powder (average particle diameter: 10 μm)

As a fatigue test, the obtained square bar shaped sintered alloy sample was machined to produce a test piece having an outer diameter of 12 mm at both ends and a central notch diameter of 8 mm, and a rotary bending fatigue testing machine was then used to measure the fatigue strength by conducting a rotary bending fatigue test. Further, for a wear test, a wear testing device was constructed by attaching a valve to the bottom end of a piston that can be driven back and forth in the vertical direction, securing the circular cylindrically shaped sintered alloy sample with the axial direction aligned vertically, and then inserting the valve stem of the valve inside the sample. In a 300° C. exhaust gas atmosphere, the valve was then moved back and forth under conditions including a stroke speed of 3,000 repetitions/minute and a stroke length of 8 mm while a lateral load of 5 MPa was applied to the piston, and after 10 hours of this back and forth movement, the amount of wear (μm) on the inner peripheral surface of the sintered alloy sample was measured.

Moreover, a cross-section of each sample was mirror polished, and after etching of the cross-sectional surface with natal solution (nitric acid:ethyl alcohol=3:100), the metal structure of the cross-section was inspected under a microscope at a magnification of 200× to investigate the structure of the matrix. In addition, using WinROOF produced by Mitani Corporation as image analysis software, an image analysis of the structure cross-section was conducted, and by binarizing the image, the area of the martensite phase was measured, and the area ratio of the martensite phase within the matrix cross-section was determined. Further, in terms of the size of the martensite phase, the average area per single phase was calculated and then converted to an area-equivalent circle diameter. These results are shown in Table 2. In the "matrix structure" column in Table 2, the basic structure of the matrix was recorded, wherein "P" means pearlite, "F" means ferrite, and "θ" means cementite. Moreover, the density values for the sintered bodies were measured using the sintered density test method for metal sintered materials prescribed in Japanese Industrial Standard (JIS) Z2505.

TABLE 1

| Sample | Blend proportions % by mass | | | | | | Overall composition % by mass | | | | |
|---|---|---|---|---|---|---|---|---|---|---|---|
| | Iron | Copper-phosphorus alloy powder | | | Nickel | Graphite | | | | | |
| No. | powder | Cu-8P | Cu-20P | Cu-5P | powder | powder | Fe | Cu | P | Ni | C |
| 1 | balance | 3.0 | | | 0.0 | 1.0 | balance | 2.76 | 0.24 | 0.00 | 1.00 |
| 2 | balance | 3.0 | | | 0.2 | 1.0 | balance | 2.76 | 0.24 | 0.20 | 1.00 |
| 3 | balance | 3.0 | | | 0.5 | 1.0 | balance | 2.76 | 0.24 | 0.50 | 1.00 |
| 4 | balance | 3.0 | | | 1.0 | 1.0 | balance | 2.76 | 0.24 | 1.00 | 1.00 |
| 5 | balance | 3.0 | | | 1.5 | 1.0 | balance | 2.76 | 0.24 | 1.50 | 1.00 |
| 6 | balance | 3.0 | | | 2.0 | 1.0 | balance | 2.76 | 0.24 | 2.00 | 1.00 |
| 7 | balance | 3.0 | | | 2.5 | 1.0 | balance | 2.76 | 0.24 | 2.50 | 1.00 |
| 8 | balance | 3.0 | | | 3.0 | 1.0 | balance | 2.76 | 0.24 | 3.00 | 1.00 |
| 9 | balance | 3.0 | | | 3.5 | 1.0 | balance | 2.76 | 0.24 | 3.50 | 1.00 |
| 10 | balance | 0.0 | | | 1.0 | 1.0 | balance | 0.00 | 0.00 | 1.00 | 1.00 |
| 11 | balance | | | 1.0 | 1.0 | 1.0 | balance | 0.95 | 0.05 | 1.00 | 1.00 |
| 12 | balance | | 1.0 | | 1.0 | 1.0 | balance | 0.80 | 0.20 | 1.00 | 1.00 |
| 13 | balance | 1.0 | | | 1.0 | 1.0 | balance | 0.92 | 0.08 | 1.00 | 1.00 |
| 14 | balance | 2.0 | | | 1.0 | 1.0 | balance | 1.84 | 0.16 | 1.00 | 1.00 |
| 4 | balance | 3.0 | | | 1.0 | 1.0 | balance | 2.76 | 0.24 | 1.00 | 1.00 |
| 15 | balance | 4.0 | | | 1.0 | 1.0 | balance | 3.68 | 0.32 | 1.00 | 1.00 |
| 16 | balance | 5.0 | | | 1.0 | 1.0 | balance | 4.60 | 0.40 | 1.00 | 1.00 |
| 17 | balance | 6.0 | | | 1.0 | 1.0 | balance | 5.52 | 0.48 | 1.00 | 1.00 |
| 18 | balance | | | 6.0 | 1.0 | 1.0 | balance | 5.70 | 0.30 | 1.00 | 1.00 |
| 19 | balance | | 6.0 | | 1.0 | 1.0 | balance | 4.80 | 1.20 | 1.00 | 1.00 |
| 20 | balance | 7.0 | | | 1.0 | 1.0 | balance | 6.44 | 0.56 | 1.00 | 1.00 |
| 21 | balance | 3.0 | | | 1.0 | 0.0 | balance | 2.76 | 0.24 | 1.00 | 0.00 |
| 22 | balance | 3.0 | | | 1.0 | 0.25 | balance | 2.76 | 0.24 | 1.00 | 0.25 |
| 23 | balance | 3.0 | | | 1.0 | 0.5 | balance | 2.76 | 0.24 | 1.00 | 0.50 |
| 24 | balance | 3.0 | | | 1.0 | 0.8 | balance | 2.76 | 0.24 | 1.00 | 0.75 |
| 4 | balance | 3.0 | | | 1.0 | 1.0 | balance | 2.76 | 0.24 | 1.00 | 1.00 |
| 25 | balance | 3.0 | | | 1.0 | 1.25 | balance | 2.76 | 0.24 | 1.00 | 1.25 |
| 26 | balance | 3.0 | | | 1.0 | 1.5 | balance | 2.76 | 0.24 | 1.00 | 1.50 |
| 27 | balance | 3.0 | | | 1.0 | 1.75 | balance | 2.76 | 0.24 | 1.00 | 1.75 |
| 28 | balance | 3.0 | | | 1.0 | 1.0 | balance | 2.76 | 0,24 | 1.00 | 1.00 |
| 29 | balance | 3.0 | | | 1.0 | 1.0 | balance | 2.76 | 0.24 | 1.00 | 1.00 |
| 4 | balance | 3.0 | | | 1.0 | 1.0 | balance | 2.76 | 0.24 | 1.00 | 1.00 |
| 30 | balance | 3.0 | | | 1.0 | 1.0 | balance | 2.76 | 0.24 | 1.00 | 1.00 |
| 31 | balance | 3.0 | | | 1.0 | 1.0 | balance | 2.76 | 0.24 | 1.00 | 1.00 |
| 32 | balance | 3.0 | | | 1.0 | 1.0 | balance | 2.76 | 0.24 | 1.00 | 1.00 |
| 33 | balance | 3.0 | | | 1.0 | 1.0 | balance | 2.76 | 0.24 | 1.00 | 1.00 |
| 34 | balance | 3.0 | | | 1.0 | 1.0 | balance | 2.76 | 0.24 | 1,00 | 1.00 |
| 35 | balance | 3.0 | | | 1.0 | 1.0 | balance | 2.76 | 0.24 | 1.00 | 1.00 |
| 4 | balance | 3.0 | | | 1.0 | 1.0 | balance | 2.76 | 0.24 | 1.00 | 1.00 |

TABLE 1-continued

| Sample No. | Blend proportions % by mass: Iron powder | Copper-phosphorus alloy powder: Cu-8P | Cu-20P | Cu-5P | Nickel powder | Graphite powder | Overall composition % by mass: Fe | Cu | P | Ni | C |
|---|---|---|---|---|---|---|---|---|---|---|---|
| 36 | balance | 3.0 | | | 1.0 | 1.0 | balance | 2.76 | 0.24 | 1.00 | 1.00 |
| 37 | balance | 3.0 | | | 1.0 | 1.0 | balance | 2.76 | 0.24 | 1.00 | 1.00 |
| 38 | balance | 3.0 | | | 1.0 | 1.0 | balance | 2.76 | 0.24 | 1.00 | 1.00 |

TABLE 2

| Sample No. | Molded body density $Mg/m^3$ | Sintering temperature ° C. | Sintered body density $Mg/m^3$ | Martensite phase: Matrix structure | Area ratio Area % | Size μm | Fatigue strength MPa | Amount of wear μm | Comments |
|---|---|---|---|---|---|---|---|---|---|
| 1 | 7.0 | 1110 | 6.90 | P | 0.0 | — | 190 | 95 | |
| 2 | 7.0 | 1110 | 6.90 | P | 1.0 | 32 | 190 | 80 | |
| 3 | 7.0 | 1110 | 6.91 | P | 2.1 | 34 | 195 | 72 | |
| 4 | 7.0 | 1110 | 6.92 | P | 3.6 | 36 | 195 | 52 | |
| 5 | 7.0 | 1110 | 6.92 | P | 5.0 | 41 | 180 | 45 | |
| 6 | 7.0 | 1110 | 6.93 | P | 6.5 | 48 | 170 | 40 | |
| 7 | 7.0 | 1110 | 6.93 | P | 8.2 | 85 | 165 | 38 | |
| 8 | 7.0 | 1110 | 6.95 | P | 10.0 | 196 | 150 | 35 | |
| 9 | 7.0 | 1110 | 6.96 | P | 12.3 | 256 | 120 | 30 | |
| 10 | 7.0 | 1110 | 6.97 | P | 0.0 | — | 125 | 103 | |
| 11 | 7.0 | 1110 | 6.95 | P | 1.0 | 33 | 150 | 79 | |
| 12 | 7.0 | 1110 | 6.90 | P | 1.8 | 42 | 150 | 63 | |
| 13 | 7.0 | 1110 | 6.94 | P | 2.6 | 35 | 155 | 68 | |
| 14 | 7.0 | 1110 | 6.93 | P | 3.2 | 35 | 170 | 63 | |
| 4 | 7.0 | 1110 | 6.92 | P | 3.6 | 36 | 195 | 52 | |
| 15 | 7.0 | 1110 | 6.96 | P | 5.4 | 38 | 180 | 49 | |
| 16 | 7.0 | 1110 | 6.80 | P | 8.6 | 42 | 170 | 47 | |
| 17 | 7.0 | 1110 | 6.75 | P | 8.7 | 56 | 165 | 44 | |
| 18 | 7.0 | 1110 | 6.85 | P | 9.9 | 38 | 150 | 54 | |
| 19 | 7.0 | 1110 | 6.50 | P | 9.8 | 72 | 150 | 27 | |
| 20 | 7.0 | 1110 | 6.70 | P | 12.3 | 106 | 95 | 31 | |
| 21 | 7.0 | 1110 | 6.97 | F | 0.5 | — | 120 | 115 | |
| 22 | 7.0 | 1110 | 6.95 | F + P | 0.7 | 35 | 140 | 96 | |
| 23 | 7.0 | 1110 | 6.94 | F + P | 1.2 | 35 | 150 | 81 | |
| 24 | 7.0 | 1110 | 6.93 | F + P | 1.8 | 35 | 170 | 74 | |
| 4 | 7.0 | 1110 | 6.92 | P | 3.6 | 36 | 195 | 52 | |
| 25 | 7.0 | 1110 | 6.91 | P | 3.8 | 36 | 170 | 44 | |
| 26 | 7.0 | 1110 | 6.90 | P | 3.8 | 36 | 150 | 34 | |
| 27 | 7.0 | 1110 | 6.89 | P + θ | 3.9 | 37 | 140 | 24 | |
| 28 | 6.5 | 1110 | 6.44 | P | 3.7 | 36 | 135 | 68 | |
| 29 | 6.8 | 1110 | 6.75 | P | 3.6 | 36 | 150 | 50 | |
| 4 | 7.0 | 1110 | 6.92 | P | 3.6 | 36 | 195 | 52 | |
| 30 | 7.2 | 1110 | 7.15 | P | 3.5 | 36 | 220 | 78 | |
| 31 | 7.3 | 1110 | — | — | — | — | — | — | Molding impossible |
| 32 | 7.0 | 900 | 6.82 | P | 0.0 | 0 | 95 | 88 | |
| 33 | 7.0 | 950 | 6.85 | P | 1.1 | 1 | 155 | 76 | |
| 34 | 7.0 | 1000 | 6.88 | P | 2.6 | 17 | 160 | 71 | |
| 35 | 7.0 | 1050 | 6.90 | P | 3.2 | 23 | 185 | 65 | |
| 4 | 7.0 | 1110 | 6.92 | P | 3.6 | 36 | 195 | 52 | |
| 36 | 7.0 | 1150 | 6.93 | P | 2.8 | 48 | 205 | 55 | |
| 37 | 7.0 | 1200 | 6.97 | P | 1.0 | 60 | 215 | 79 | |
| 38 | 7.0 | 1250 | 7.01 | P | 0.2 | 5 | 220 | 85 | |

Based on the results for sample numbers 1 to 9 in Table 2, it is evident that the addition of nickel powder causes a marked reduction in the amount of wear, and that addition of at least 0.2% by mass of nickel powder is effective in reducing the amount of wear. In this regard, the blend amount of nickel powder is preferably at least 1.0% by mass, and more preferably 1.5% by mass or greater. However, if the blend proportion of nickel powder exceeds 3.0% by mass, then a tendency for a gradual decrease in the fatigue strength is observed. Accordingly, the blend amount of nickel powder is preferably within a range from 0.2 to 3.0% by mass. Further, the proportion of the martensite phase increases as the blend proportion of nickel powder is increased, and when the blend proportion of nickel powder is within the range from 0.2 to 3.0% by mass, the proportion of the martensite phase is within a range from 1.0 to 10% by area. From the viewpoint of the wear resistance, the proportion of the martensite phase is preferably at least 3.6% by area, and is more preferably at least 5.0% by area.

In the majority of samples, it is thought that the size of the martensite phase is within a range from about 30 to 60 μm. Accordingly, the size of the martensite phase produced in the matrix can be controlled by the size of the nickel powder used, and it can be said that a martensite phase having a size of about 30 to 60 μm can be produced from nickel powder having an average particle diameter of 5 μm. However, the size of the martensite phase increases as nickel diffusion is promoted by increases in the sintering temperature, and this relationship can also be seen in the results of sample numbers 32 to 38 which had differing sintering temperatures. Furthermore, based on the fact that samples having a high martensite phase area ratio had larger martensite phases, it is thought that the diffusion range of nickel particles have overlapped, causing the joining of adjacent martensite phases. Based on the results of sample numbers 1 to 9, it is evident that when the size of the martensite phase is within a range from about 1 to 200 μm, favorable results can be obtained for both the fatigue strength and the wear resistance.

Based on the results of sample numbers 4 and 10 to 20, it is evident that addition of copper reduces the amount of wear, and that addition of at least 0.8% by mass of copper is effective in reducing the amount of wear. In this regard, the blend amount of copper is preferably at least 1.84% by mass, and more preferably 2.76% by mass or greater.

Further, when the compositional proportion of copper is within a range from 0.8 to 5.7% by mass, favorable fatigue strength can be obtained, but if the proportion exceeds this range, then the fatigue strength deteriorates, and it is thought that this observation is due to the soft copper phase or copper alloy phase. Furthermore, when the same samples are evaluated based on the compositional proportion of phosphorus, it is clear that addition of phosphorus reduces the amount of wear and also enhances the fatigue strength. It can be said that addition of 0.05 to 1.2% by mass of phosphorus is appropriate.

Based on the results of sample numbers 4 and 21 to 27, the effects of the blend proportion of carbon can be evaluated. As the proportion of carbon is increased, the structure that constitutes the matrix changes from a ferrite single phase structure to a mixed structure of ferrite and pearlite, and then to a pearlite structure. The amount of wear decreases as the proportion of carbon increases, and a proportion of carbon of at least 0.5% by mass is effective in reducing the wear resistance. In this regard, the proportion of carbon is preferably at least 0.75% by mass, and more preferably 1.0% by mass or greater. On the other hand, in the case of the fatigue strength, a clear optimal value exists in the vicinity of 1.00% by mass, and favorable fatigue strength is obtained within a range from 0.5 to 1.5% by mass.

Based on the results of sample numbers 4 and 28 to 31, the effects of the molded body density can be evaluated. The fatigue strength improves as the molded body density increases, and favorable fatigue strength is exhibited when the molded body density is at least 6.5 $Mg/m^3$. A density of at least 6.8 $Mg/m^3$ is preferred, and the fatigue strength is extremely high at densities of 7.0 $Mg/m^3$ or higher. However, because of molding limitations, a density of no more than 7.2 $Mg/m^3$ is appropriate. On the other hand, in terms of the wear resistance, the ideal density at which the minimum amount of wear is observed exists within a density range from 6.7 to 7.2 $Mg/m^3$.

Based on the results of sample numbers 4 and 32 to 38, the effects of the sintering temperature can be evaluated. As the sintering temperature is increased, the fatigue strength increases, and at a sintering temperature of 950° C. or higher, favorable fatigue strength can be imparted. In this regard, the sintering temperature is preferably at least 1,050° C., and more preferably 1,100° C. or higher. The amount of wear also decreases as the sintering temperature is increased. However, in terms of the wear resistance, it is thought that the optimal sintering temperature is about 1,110° C. Because the change trend in the amount of wear and the change trend in the proportion of the martensite phase correspond, the optimal range for the sintering temperature can be said to be from 950 to 1,200° C., and preferably from 1,000 to 1,150° C.

For the sintered alloy sample of sample number 4, a captured optical microscope image of a structure cross-section is illustrated in FIG. 1.

The matrix has a structure composed of martensite dispersed in a pearlite single phase structure, wherein some micronized pearlite structures have been partially produced. Factors that can cause micronization of the pearlite structure include the hardening effect of copper, and the production of fine Fe—P—C compounds within the pearlite due to the introduction of phosphorus.

Figure 2:
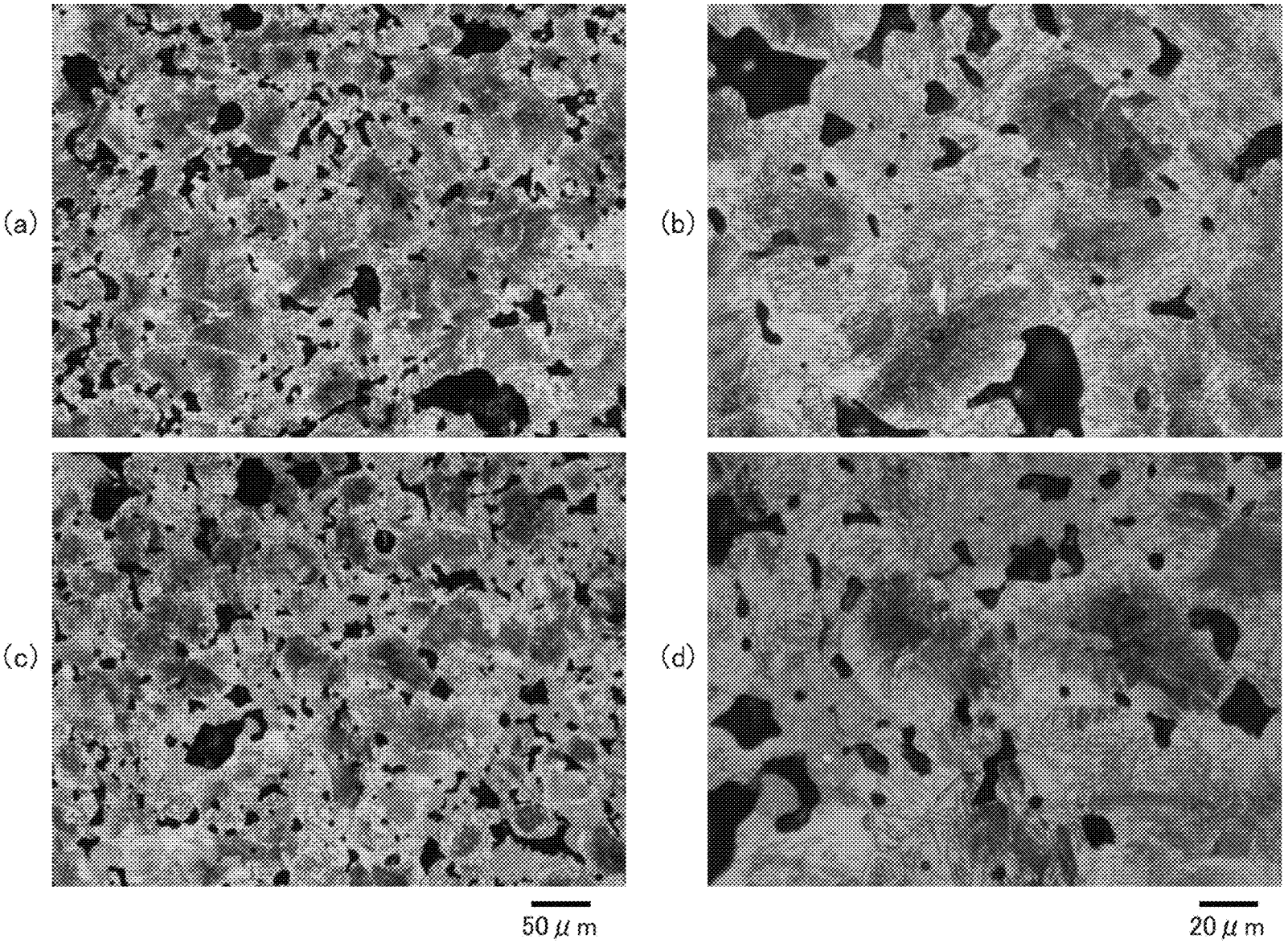
FIG. 2 shows captured images of structure cross-sections illustrating examples of the metallic structure of a sintered valve guide of the present invention, wherein (a) and (b) are structure cross-sections of a sample No. 4, and (c) and (d) are structure cross-sections of a sample No. 6, both of which are described in the examples.

FIG. 2 shows captured optical microscope images of structure cross-sections used for comparing the differences resulting from different compositional proportions of nickel, wherein (a) and (b) are structure cross-sections of the sample number 4, and (c) and (d) are structure cross-sections of the sample number 6 containing a large amount of nickel. The fact that a difference in the amount of nickel yields a different proportion for the produced martensite phase can also be understood based on FIG. 2.

Example 2

The powders (a) to (f) used in EXAMPLE 1 and a manganese sulfide powder (average particle diameter: 5 μm) were prepared as raw materials, and were combined and mixed in the blend proportions shown in Table 3 to prepare raw material mixed powders. Using the obtained raw material mixed powders, pressure powder molding was conducted in the same manner as EXAMPLE 1, obtaining molded bodies having the densities shown in Table 4. The thus obtained molded bodies were subjected to sintering and cooling under the same conditions as EXAMPLE 1, thus producing sintered alloy samples of sample numbers 39 to 43.

Using each of the obtained sintered alloy samples, the same procedures as EXAMPLE 1 were used to measure the fatigue strength by rotary bending fatigue testing, and the amount of wear of the inner peripheral surface. Moreover, each of the circular cylindrically shaped sintered alloy samples from sample number 4 and sample numbers 39 to 43 was turned using an ultra-hard alloy turning cutter to investigate the machinability. In other words, the end surface of the sample was turned with the turning cutter from the outer peripheral surface toward the inner periphery (cutting speed: 50 m/min, cutting depth: 0.2 mm, feed rate: 0.05 mm/revolution), and when the total cutting distance reached 1,000 m, the amount of wear of the flank of the cutter (the amount of tool wear) was measured. This measured value is recorded in Table 4 as an indicator for evaluating the machinability.

INDUSTRIAL APPLICABILITY

The present invention provides a sintered valve guide having improved strength and excellent wear resistance and machinability, and by supplying favorable products compatible with internal combustion engines of improved functionality (such as lower fuel consumption and higher output), can contribute to energy conservation and environmental preservation.

The present invention is related to the subject matter disclosed in prior Japanese Application 2018-030672 filed on Feb. 23, 2018, the entire contents of which are incorporated by reference herein.

TABLE 3

| | Blend proportions % by mass | | | | | Overall composition % by mass | | | | | |
|---|---|---|---|---|---|---|---|---|---|---|---|
| Sample No. | Iron powder | Copper-phosphorus alloy powder Cu-8P | Nickel powder | Graphite powder | MnS powder | Fe | Cu | P | Ni | C | MnS |
| 4 | balance | 3.0 | 1.0 | 1.0 | 0.0 | balance | 2.76 | 0.24 | 1.00 | 1.00 | 0.00 |
| 39 | balance | 3.0 | 1.5 | 1.0 | 0.1 | balance | 2.76 | 0.24 | 1.50 | 1.00 | 0.10 |
| 40 | balance | 3.0 | 2.0 | 1.0 | 0.5 | balance | 2.76 | 0.24 | 2.00 | 1.00 | 0.50 |
| 41 | balance | 3.0 | 2.5 | 1.0 | 1.0 | balance | 2.76 | 0.24 | 2.50 | 1.00 | 1.00 |
| 42 | balance | 3.0 | 3.0 | 1.0 | 1.5 | balance | 2.76 | 0.24 | 3.00 | 1.00 | 1.50 |
| 43 | balance | 3.0 | 3.5 | 1.0 | 2.0 | balance | 2.76 | 0.24 | 3.50 | 1.00 | 2.00 |

TABLE 4

| Sample No. | Molded body density $Mg/m^3$ | Sintering temperature ° C. | Sintered body density $Mg/m^3$ | Matrix structure | Martensite phase Area ratio Area % | Martensite phase Size μm | Fatigue strength MPa | Amount of wear μm | Amount of tool wear μm | comments |
|---|---|---|---|---|---|---|---|---|---|---|
| 4 | 7.0 | 1110 | 6.92 | P | 3.6 | 36 | 195 | 52 | 155 | |
| 39 | 7.0 | 1110 | 6.91 | P | 3.6 | 36 | 195 | 50 | 150 | |
| 40 | 7.0 | 1110 | 6.87 | P | 3.6 | 36 | 185 | 48 | 135 | |
| 41 | 7.0 | 1110 | 6.84 | P | 3.6 | 36 | 170 | 51 | 115 | |
| 42 | 7.0 | 1110 | 6.81 | P | 3.6 | 36 | 150 | 47 | 90 | |
| 43 | 7.0 | 1110 | 6.78 | P | 3.6 | 36 | 130 | 45 | 90 | |

Sample numbers 39 to 43 are sintered alloys containing manganese sulfide as a machinability improver. As is evident from the results in Table 4, by adding 0.1% by mass of manganese sulfide, a reduction in the amount of tool wear is observed, and the amount of tool wear decreases in accordance with the amount of manganese sulfide added. In other words, when the blend proportion of manganese sulfide is within a range from 0.1 to 2.0% by mass, there is a clear improvement in the machinability of the sintered alloy. However, a decrease in the fatigue strength is observed, and if this factor is taken into consideration, then the blend proportion of manganese sulfide is preferably not more than 1.5% by mass. Based on the results in Table 4, the addition of manganese sulfide has no effect on the formation of the alloy matrix or the formation of the martensite phase. This is because the manganese sulfide is dispersed by itself within the matrix or the pore. It has been confirmed that the type of machinability improvement effect evident in Table 4 can be similarly obtained by addition of boron nitride or a magnesium silicate mineral instead of manganese sulfide, and the preferred blend proportions are from about 0.01 to 0.5% by mass for boron nitride, and from about 0.05 to 1.0% by mass for a magnesium silicate mineral.

It should be noted that, besides those already mentioned above, many modifications and variations of the above embodiments may be made to the above embodiments without departing from the novel and advantageous features of the present invention. Accordingly, all such modifications and variations are intended to be included within the scope of the appended claims.

DESCRIPTION OF THE REFERENCE SIGNS

1: Matrix
2: Pore
3, 3': Pearlite
4: Martensite phase

The invention claimed is:

1. A sintered valve guide having a metallic structure that has a matrix composed of a martensite phase dispersed in a mixed structure of ferrite and pearlite, and pores dispersed within the matrix, wherein the martensite phase exists in a proportion such that an area ratio of the martensite phase in a structure cross-section is within a range from 1 to 10% of the matrix, and wherein a composition of the sintered valve guide comprises, by mass, 0.8 to 5.7% of Cu, 0.2 to 3.0% of Ni, 0.24 to 1.2% of P, and 0.5 to 1.5% of C, with a remainder comprising Fe and unavoidable impurities, and wherein the martensite phase is of a size having an average area-equivalent circle diameter of 1 to 200 μm in a structure cross-section.

2. The sintered valve guide according to claim 1, wherein the composition of the sintered valve guide comprises, by mass, 1.5 to 3.0% of Ni.

3. The sintered valve guide according to claim 1, wherein the composition of the sintered valve guide comprises, by mass, 0.8 to 5.7% of Cu, 0.2 to 2.0% of Ni, 0.24 to 1.2% of P, 0.5 to 1.5% of C, and 0.01 to 1.5% of a machinability improver, with a remainder comprising Fe and unavoidable impurities.

4. The sintered valve guide according to claim 1, wherein the matrix composed of a martensite phase dispersed in a mixed structure of ferrite and pearlite, and pores dispersed within the matrix, contains an Fe—P—C compound in the pearlite, and wherein the pearlite is partially micronized.

5. The sintered valve guide according to claim 3, wherein the machinability improver comprises, by mass relative to the composition, at least one of 0.01 to 0.5% of boron nitride, 0.05 to 1.0% of a magnesium silicate mineral, and 0.1 to 1.5% of manganese sulfide.

* * * * *